United States Patent [19]

Hart et al.

[11] 3,999,615

[45] Dec. 28, 1976

[54] MOTOR GRADER WITH CIRCLE MOUNTING BLADE AND WEDGE CONTROL SYSTEM

[75] Inventors: Francis H. Hart, Sao Paulo, Brazil; Carl A. Higar, Mount Zion, Ill.

[73] Assignee: Caterpillar Tractor Co., Peoria, Ill.

[22] Filed: Apr. 23, 1975

[21] Appl. No.: 571,033

[52] U.S. Cl. ..... 172/796; 172/742

[51] Int. Cl.[2] ..... E02F 3/76; E02F 3/85

[58] Field of Search ..... 172/4, 4.5, 734, 737, 172/741, 753, 762, 763, 781, 784, 785, 786, 787, 788, 789, 790, 791, 792, 793, 794, 795, 796, 797, 742

[56] References Cited

UNITED STATES PATENTS

| | | | |
|---|---|---|---|
| 1,698,435 | 1/1929 | Gustafson | 172/797 |
| 1,841,403 | 1/1932 | Dean | 172/796 |
| 2,189,344 | 2/1940 | Gustafson | 172/793 |
| 2,247,464 | 7/1941 | Arndt | 172/793 |
| 2,258,890 | 10/1941 | Gustafson | 172/793 |
| 2,278,806 | 4/1942 | Tilton | 172/792 |
| 2,737,736 | 3/1956 | Macdonald | 172/797 |
| 2,961,783 | 11/1960 | Bowen et al. | 172/4.5 |
| 3,303,589 | 2/1967 | Rivinius | 172/4.5 |
| 3,568,778 | 3/1971 | Swisher, Jr. et al. | 172/785 |
| 3,593,806 | 7/1971 | Gurries | 172/741 |
| 3,899,028 | 8/1975 | Morris et al. | 172/4.5 |

*Primary Examiner*—Richard T. Stouffer
*Attorney, Agent, or Firm*—Phillips, Moore, Weissenberger Lempio & Strabala

[57] ABSTRACT

A control system for circle mounted motor grader blades to enable adjustment of the circle and blade supported thereby about the axis of the circle is disclosed. The system includes a circle holding mechanism for reducing wear between the circle and the mounting structure therefor, which circle holding mechanism also automatically compensates for inaccuracies in operation due to such wear and to the tolerances between the circle and the mounting structure required to facilitate adjustments in the relative positioning thereof. This circle holding mechanism includes a wedge device which forces the circle into a shoe element to hold the circle in fixed relationship with respect to the mounting structure therefor.

10 Claims, 5 Drawing Figures

MOTOR GRADER WITH CIRCLE MOUNTING BLADE AND WEDGE CONTROL SYSTEM

BACKGROUND OF THE INVENTION

This invention relates to a control system for motor graders and the like having a circle mounted blade or moldboard, and more particularly to a control system for adjusting the position of the circle mounted blade about the axis of the circle, which system includes means for automatically exerting a holding force between the circle and the circle mounting structure to thereby hold the circle and blade supported thereby against movement during grading operations, thus enabling a significant improvement in the smoothness and accuracy of the grade surface produced by the motor grader.

It will be understood that during grading operations it is often necessary to adjust the angle of the blade of the motor grader with respect to the direction of travel of the motor grader depending upon the width of the strip of surface to be graded and upon the amount of material picked up by the blade at a particular point in the grading operation. Thus, the operator of the motor grader may make adjustments in the angle of the blade with respect to the direction of travel of the motor grader by rotating the circle upon which the blade is mounted about its axis. The prior art control systems for enabling the adjustment of the angle of the blade with respect to the direction of motion of the motor grader have seriously reduced the accuracy and smoothness of the graded surface which could be produced due to the working clearances and tolerances required between the blade supporting circle member and the mounting structure therefor as well as the normally expected wear on the mating surfaces of the blade supporting circle member and its mounting structure.

It will be understood that the vertical positioning of the blade with respect to the surface to be graded is established by other control means of the motor grader and that any change in such vertical positioning due to the operation of control means for adjusting the angle of the blade with respect to the direction of travel of the motor grader will reduce the smoothness and accuracy of the resulting grade surface. Modern motor graders use an automatic blade control (A. B. C.) device for reading the desired grade level from a reference grade line or wire and automatically adjusting the vertical positioning of the blade to maintain the reference level. However, such devices cannot compensate for changes in the vertical positioning of the blade due to wear in the mating surfaces of the blade support structure and any changes in the vertical positioning of the blade which may occur during adjustment of the angle of the blade with respect to the direction of motion of the motor grader will result in departures from the reference grade level. Since tolerances as small as ⅛ inch are now required in road grading operations, it will be seen that departures from the reference grade level during the adjustment of the angle of the blade with respect to the direction of motion of the grader, or the working tolerances and wear inherent in the mounting structures which enable such adjustment of the blade, have made prior art control systems for such adjustment impractical or undesirable.

SUMMARY OF THE INVENTION

According to this invention, a motor grader comprising a main frame having a drawbar structure attached thereto and a working blade mounted on a circle member which is rotatably supported under the drawbar structure with the upper surface thereof vertically spaced from a lower surface of the drawbar structure by means of a plurality of spaced shoes rigidly fixed to the drawbar structure and slidably engaging the lower surface of the circle is provided with a control system comprising means for selectively rotating the circle and blade mounted thereon with respect to the drawbar structure about the axis of the circle and wedge means for selectively exerting a holding force simultaneously upon the lower surface of the drawbar structure and the upper surface of the circle to force the lower surface of the circle against the shoes and hold the circle and blade mounted thereon substantially immovable with respect to the drawbar structure in any position to which the circle is selectively rotated about its axis with respect to the drawbar structure.

Thus, it is an object of this invention to provide a control system for enabling adjustment of the angle of the blade of a motor grader with respect to the direction of motion of the motor grader without change in the vertical positioning of such blade with respect to the working surface.

It is another object of this invention to provide means for holding the working blade substantially immovable with respect to the structure by which it is mounted on the motor grader during operation in order to reduce wear in such mounting structure.

BRIEF DESCRIPTION OF THE DRAWING

The foregoing and other objects and features of the subject invention will be more fully understood from the following detailed description of a preferred embodiment thereof when read in conjunction with the attached drawings wherein.

DETAILED DESCRIPTION OF A PREFERRED EMBODIMENT

Figure 1:
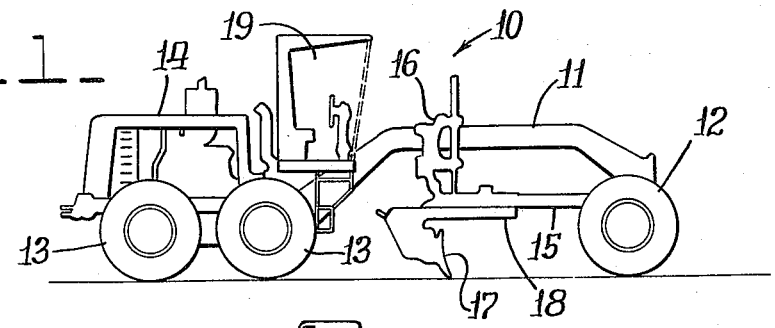
FIG. 1 is a simplified side view in elevation of a motor grader embodying this invention.

A motor grader 10 to which this invention is applicable is depicted in simplified form in FIG. 1. Such a motor grader comprises an elongated arched frame 11 supported at the front end by a pair of steerable wheels 12 and at the rear end by one or more pairs of fixed driving wheels 13. An appropriate engine unit 14 is mounted on the frame 11 over the driving wheels 13 and supplies the motive power for the motor grader as well as the power for operating the various control systems thereof.

An elongated drawbar structure 15 is mounted under the arched portion of the frame 11 with one end connected to the forward end of the frame 11 by means of a universal joint (not shown). The other end of the drawbar structure 15 is mounted on the arched portion of the frame 11 by appropriate control devices such as hydraulic motor adapted to enable the drawbar structure 15 to be pivoted about the universal joint at the other end thereof with respect to the frame 11.

A working implement such as an elongated blade 17 is mounted on a circle structure 18 which is in turn mounted for rotary movement about its axis on the end of the drawbar structure 15 remote from the universal joint by which such drawbar structure is attached to the frame 11. Appropriate controls for the operation of the motor grader are located at an operator's station 19 mounted on the frame 11 intermediate the engine unit 14 and the arched portion of the frame and may include a cab adapted to protect the operator from the elements without obstructing the operator's view of the working implement or blade 17 and the front wheels 12 of the motor grader.

Figure 2:
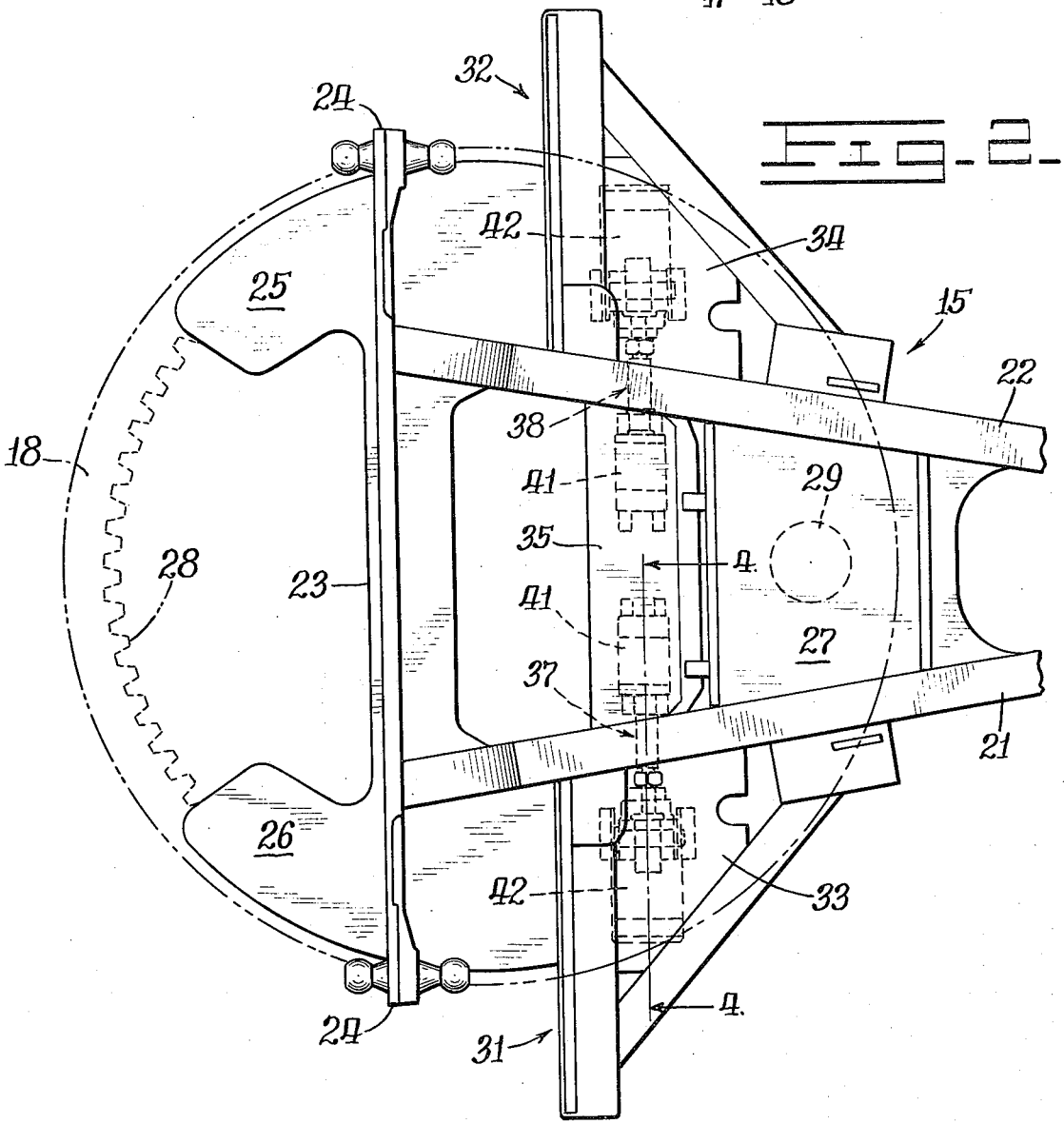
FIG. 2 is an enlarged fragmentary top view of the end portion of the drawbar structure of the motor grader of FIG. 1 which carries the circle mounted blade with the circle member and control system of this invention indicated in phantom.

FIG. 2 is an enlarged top view of the end of the drawbar structure 15 remote from the universal joint by which it is attached to the frame 11. For clarity of illustration the circle structure 18 is shown in phantom and the working implement or blade 17 is omitted. Thus, it will be seen that the drawbar structure 15 is basically a triangle comprising a pair of elongated girders 21 and 22 which form the sides of the triangle and converge to an apex at the universal joint by which the drawbar structure 15 is attached to the frame 11. The base of the triangle is formed by a third girder 23 having projecting ends 24 which are provided with ball joint connecting means for attachment of the control devices 16 by which the free end of the drawbar structure 15 is mounted on the arched portion of the frame 11.

The circle structure 18 is rotatably mounted under the drawbar structure 15 by means of three spaced shoe structures 25, 26 and 27 which are rigidly mounted on the drawbar structure 15. As shown in FIG. 2, the shoe structures 25 and 26 are mounted at opposite ends of the girder 23 which forms the base of the triangular drawbar structure 15 and the third shoe structure 27 is mounted between the girders 21 and 22 which form the sides of the triangular drawbar structure 15. By such three-point support of the circle structure 18, the axis of such circle structure is fixed with respect to the drawbar structure 15 and the circle structure 18 may be raised and lowered with respect to the arched portion of the frame 11 or the axis thereof may be tilted with respect to the frame 11 by means of the control devices 16 attached to the swivel connection means at the ends 24 of the girder 23.

As shown in phantom in FIG. 2, the inner periphery of the circle structure 18 is provided with gear teeth 28 adapted to engage an appropriate drive means 29 also shown in phantom in FIG. 2 as being mounted on the shoe structure 27. Such drive means 29 may comprise a worm or spur gear driven by an appropriate electrical or hydraulic motor, for example, and could be mounted elsewhere on the drawbar structure 15.

Thus, it will be seen that the working implement or blade 17 carried by the circle structure 18 may be raised and lowered or tilted with respect to the surface upon which the motor grader 10 is traveling by means of the control devices 16. In addition, the angle of the working implement or blade 17 with respect to the direction of travel of the motor grader 10 may be changed through rotation of the circle structure 18 by engagement of the drive means 29 with the gear teeth 28 at the inner periphery thereof.

Thus, in operation, the vertical position of the working implement or blade 17 and the tilt thereof with respect to the surface to be graded is set by adjustment of the control devices 16. As the motor grader is driven along such surface, the working implement or blade 17 will scrape up the desired upper portion of such surface collecting the material scraped up and tending to deposit such material in windrows at one or both ends of the blade 17 depending on the angle of such blade 17 with respect to the direction of travel of the motor grader 10.

It will be understood that the purpose of such operation is to smooth an uneven surface or change the grade of such surface. In any event, the amount of material scraped up by the blade 17 at various points in the travel of the motor grader 10 along such surface will vary. At times the amount of such material will become large enough to cause such material to be forced upwardly against the underside of the circle structure 18 and free end of the drawbar structure 15, tending to pass over the upper edge of the blade 17 and be redeposited therebehind. This undesirable result may be avoided by changing the angle of the blade with respect to the direction of travel of the motor grader 10 to cause the material to be more rapidly discharged into a windrow at one end of the blade.

Thus, during a particular pass of the motor grader 10 over a surface to be graded, the angle of the blade 17 with respect to the direction of travel of the motor grader 10 may be changed although the vertical positioning and tilt of the blade with respect to such surface must remain constant. Modern road graders include automatic blade control devices which function to maintain the vertical positioning and tilt of the blade with respect to the surface constant within a tolerance of ⅛ inch (4 mm). However, the necessary rotation of the circle structure 18 with respect to the drawbar structure 15 to change the angle of the blade 17 or other working implement with respect to the direction of travel of the motor grader has introduced a serious problem with respect to maintaining the graded surface within the tolerance which the automatic blade control devices are capable of producing and which is in fact required by the specifications for many modern road surfaces.

It will be understood that a certain clearance is required in the mounting of the circle structure 18 on the drawbar structure 15 by means of the shoes 25, 26 and 27 in order to enable the angle of the blade 17 with respect to the direction of motion of the motor grader 10 to be changed by rotation of the circle structure 18 about its axis. In addition, such rotational movement of the circle structure 18 will produce wear both of the circle structure itself and of the shoes 25, 26 and 27 by which it is mounted on the drawbar structure 15.

Such wear is complicated by the fact that the mating surfaces involved are exposed to the entry of abrasive materials from the surface being graded such as particles of dirt and fine gravel, etc. Such abrasive materials will tend to be captured in the lubricant present between the mating surfaces producing, in effect, a grinding compound which will accelerate the wearing process.

It will be understood that the working implement or blade 17 will be subject to extreme vibration in operation as it scrapes along the surface to be graded. Such vibrations, as well as the rotary movement involved in changing the angle of the blade with respect to the direction of motion of the motor grader along the surface will power the grinding process, accelerating the wear of the mating surfaces. The wearing of the mating surfaces will increase the undesirable vertical movement between the blade and the surface being graded permitted by the necessary tolerance between such mating surfaces.

According to this invention, means are provided for selectively exerting a holding force simultaneously on a lower surface provided on the drawbar structure 15 and the adjacent upper surface of the circle 18, thereby forcing the lower surface of the circle 18 against the shoes 25, 26 and 27, by which it is supported, to rigidly fix the circle and drawbar with respect to each other against vibrational forces and prevent the entry of abrasive materials between the circle and the shoes. Thus, the wearing of the circle and shoes due to vibration in operation will be reduced. Furthermore, the release of the holding force to allow adjustment of the circle about its axis with respect to the drawbar will not result in any axial displacement of the circle, so that the vertical positioning of the blade with respect to the working surface will not change. Finally, the amount of abrasive material present between the circle and shoe during rotational adjustment of the circle will be reduced providing a further reduction in the wear between the circle and shoes.

Figure 3:
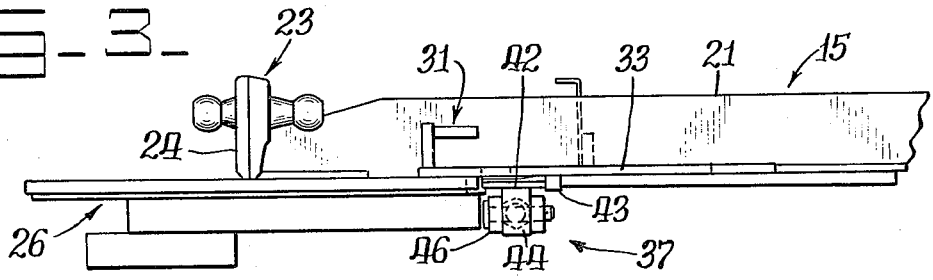
FIG. 3 is a fragmentary side view in elevation of the end of the drawbar structure shown in FIG. 2.
Figure 4:
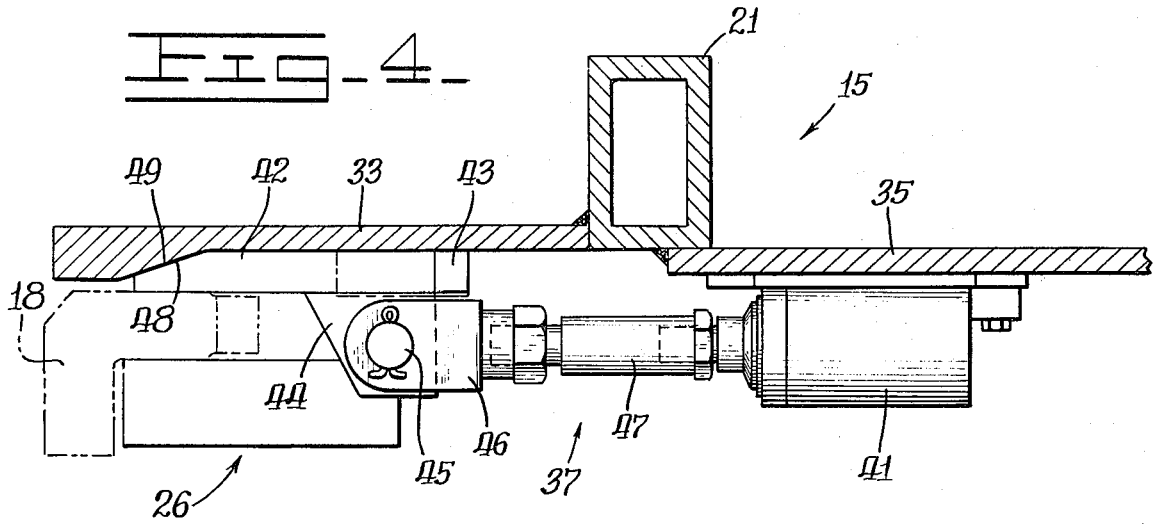
FIG. 4 is a view taken along lines 4—4 of FIG. 2 with the drawbar structure shown in cross section, the circle member shown in phantom and a portion of the control system of this invention shown in full.

According to the embodiment of this invention shown in FIGS. 2, 3 and 4 of the drawing, the drawbar structure 15 is provided with a pair of laterally extending support wings 31 and 32 on opposite sides thereof together with appropriate mounting plates 33, 34 and 35. A pair of wedging devices 37 and 38 are mounted on the mounting plates 33, 34 and 35, as indicated in phantom in FIG. 2.

As best shown in FIG. 4, each of such wedging devices 37 and 38 comprise a double-acting hydraulic cylinder 41 mounted on the undersurface of the mounting plate 35. A wedge member 42 is slidably supported on the lower surface of the mounting plates 33 and 34 by means of opposing guide members 43. Each of the wedge members 42 is provided with a downwardly extending leg 44 which is apertured to receive a pivot pin 45. The pivot pin 45 connects the bracket member 46 at one end of a linkage member 47 to the leg 44, the other end of the linkage member 47 being connected to the rod of one of the double acting hydraulic cylinders 41.

Thus, actuation of the hydraulic cylinder 41 in one sense will tend to force the wedge member 42 to slide outward of the circle 18 in the guide members 43 and between the upper surface of the circle 18 and lower surface of the plate 33, (or 34). Actuation of the hydraulic cylinder 41 in the opposite sense will retract the wedge member 42 from between the upper surface of the circle 18 and lower surface of the plate 33 (or 34). Although a single wedging device could be used, it will be understood that a pair of wedging devices are preferred in order to equalize the radial forces applied to the circle 18 and thereby avoid the possibility of undesirable shifting of the axis of the circle 18 due to the wedging action.

As best seen in FIG. 4, the wedge member 42 has a tapered upper wear surface 48 that abuts a correspondingly tapered wear surface 49 provided on the underside of the mounting plate 33 when the wedging member 42 is forced radially outward of the circle 18 to its wedging position. The position shown in FIG. 4 is produced when hydraulic power is applied to the cylinder head end of the hydraulic cylinder 41, thus causing the rod thereof and linkage member 41 to move outwardly of the circle structure 18. Thus, the tapered surface 48 on the wedge member 42 engages the tapered surface 49 on the support plate 33 (34) exerting a holding force simultaneously on the drawbar structure and the upper surface of the circle structure 18, forcing the lower surface of the circle structure against the supporting surface of the shoes 26 (25, 27). Such holding force not only prevents rotation of the circle structure with respect to the drawbar structure but also prevents relative motion therebetween due to vibrational forces.

When it is desired to adjust the angle of the blade 17 with respect to the direction of motion of the motor grader 10, hydraulic pressure is applied to the rod end of the hydraulic cylinder 41 to pull the wedge member 42 inwardly of the circle structure 18, removing the tapered surface 48 thereof from engagement with the tapered wear surface 49 provided on the support plate 33 (34). Thus, the circle structure 18 may be rotated on the shoes 25, 26 and 27 by the drive means 29 to any desired orientation, at which time the wedging devices may again be actuated to lock the circle structure 18 with respect to the drawbar structure 15.

It has been found that the angle of the tapered surfaces 48 and 49 with respect to the upper surface of the circle 18 and lower surface of the plate 33 (34), respectively, should be about 10°. If such angle is larger than 10°, then the compressive force which must be provided by the cylinder 41 at the abutting surfaces 48 and 49 in order to lock the circle 18 with respect to the drawbar 15, will be increased. Similarly, if such angle is less than 10°, then the force which the cylinder 41 must exert in order to remove the surface 48 of the wedge member 42 from locking engagement with the surface 49 will be increased.

From the above it will be understood that the use of a double-acting hydraulic cylinder 41 is an essential element of this invention since force is required both to lock and to unlock the circle 18 with respect to the drawbar structure 15. Thus, referring to FIG. 5, the control system of this invention is illustrated schematically and includes means for automatically actuating the wedging devices of this invention in the appropriate sense depending on whether or not the drive means for rotating the circle structure 18 is actuated.

Figure 5:
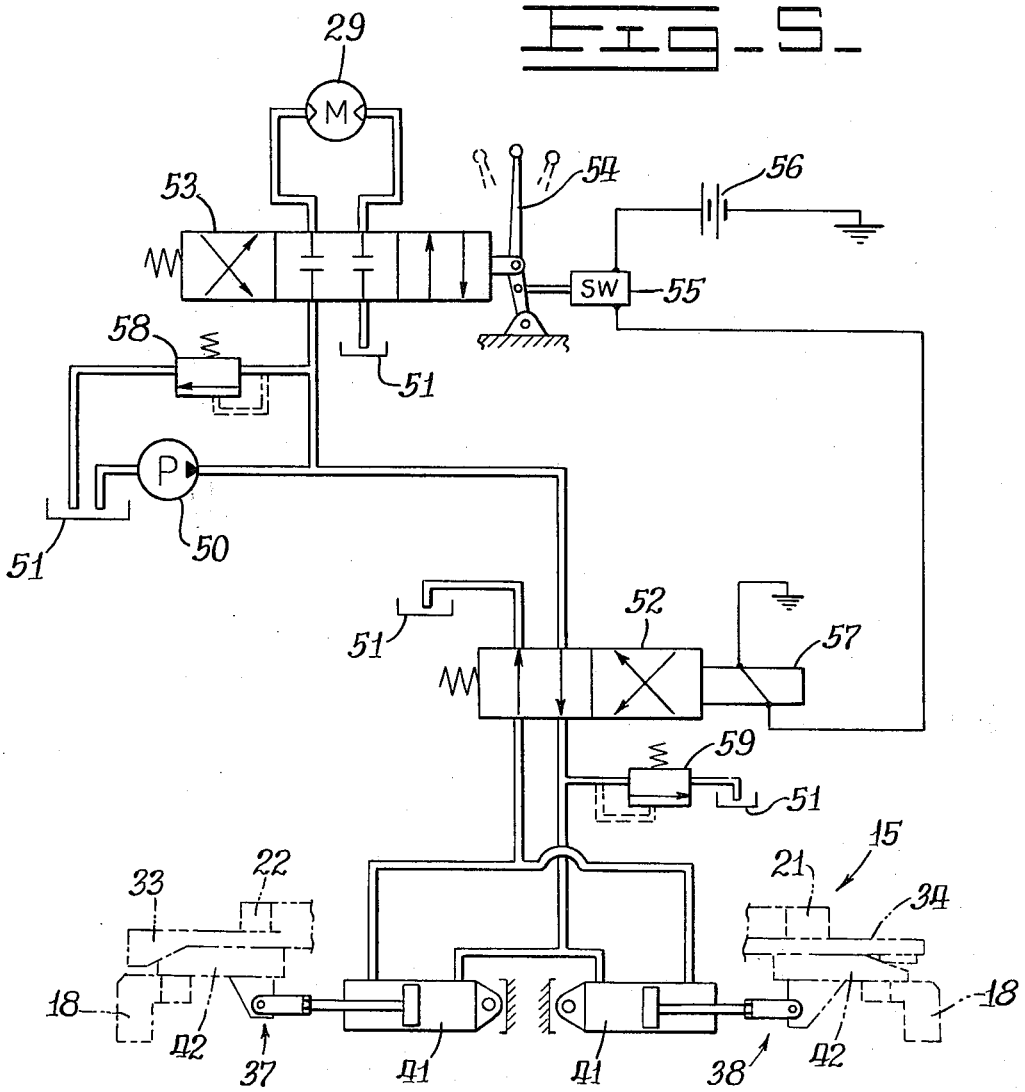
FIG. 5 is a schematic representation of the hydraulic and electrical circuits of the control system of this invention together with a fragmentary representation in phantom of certain mechanical elements of the motor grader in operative relation thereto.

Thus, as shown in FIG. 5, a hydraulic pump 50 which may be driven by the engine unit 14 provides hydraulic fluid under pressure from a reservoir 51 both to a two-way control valve 52 connected in parallel to the wedging devices 37 and 38 and to a three-way control valve 53 connected to the drive means 29 by means of which the circle structure 18 is rotated about its axis. As shown in FIG. 5 the control valve 52 is in position to apply hydraulic fluid under pressure from the pump 50 to the head end of the double-acting hydraulic cylinders 41 to thereby actuate the wedging means 37 and 38, as described above, to lock the circle structure 18 with respect to the drawbar structure 15 and the control valve 53 is shown in its neutral position in which the drive means 29 is disconnected from the pressurized fluid provided by the pump 50.

A manually operated control lever 54 is mechanically connected to the slide member of the valve 53 so that movement of the control lever 54 in one direction will actuate the drive means 29 to rotate the circle structure 18 in one direction about its axis whereas movement of the control lever 54 in the opposite direction will actuate the drive means 29 to rotate the circle structure 18 in the opposite direction about its axis. The control lever 54 is also mechanically connected to means for automatically moving the slide member of the two-way valve 52 to its opposite position whenever the control lever 54 is moved to actuate the drive means 29 to rotate the circle structure 18 in either direction.

As shown in the drawing, such means may comprise an electrical swtich 55 connected in series across the vehicle battery 56 with an appropriate electromagnetic device 57 mechanically coupled to the slide member of the two-way valve 52. The slide member of the two-way valve 52 would be spring-loaded to normally rest in the position shown and the switch member 55 would be adapted to establish the flow of electric current through the electromagnetic device 57 whenever the control lever 54 is moved from its position as shown in FIG. 5. It will be understood that movement of the slide member of the valve 52 to its alternate position due to energization of the electromagnetic means 57 will cause high pressure fluid from the pump 50 to be applied to the rod end of the hydraulic cylnders 41 to thereby retract the wedge members 42 from their position as shown in FIG. 5.

As shown in FIG. 5, a pressure relief valve 58 is provided at the outlet of the pump 50 in order to limit the maximum pressure of the hydraulic fluid in the system. It will be understood that such pressure is preferably fairly high in order to insure that sufficient power will be available to the drive means 29 to rotate the blade against resistance which may be encountered in operation. However, such pressure will tend to be substantially higher than would be desirable for constant application to the head end of the hydraulic cylinders 41 when the wedge members 42 are in their locking position. Thus, a second pressure relief valve 59 is provided in the hydraulic line leading from the control valve 52 to the head end of the hydraulic cylinders 41 and is adapted to maintain a lower maximum pressure in the hydraulic circuit than that provided by the relief valve 58 when the entire mechanism is in the condition illustrated in FIG. 5.

When the control lever 54 is moved to actuate the drive means 29 to rotate the circle structure 18 in either direction, the slide of the valve means 52 will be moved to its alternate position. It will be seen that in this condition the full pressure established by the relief valve 58 will tend to be available at the rod end of the hydraulic cylinders 41 for withdrawing the slide members 42 from their locking position. Such pressure will be reduced due to the fact that the drive means 29 will be actuated, but may still be substantially higher than the pressure established by the relief valve 59. It will be understood, however, that the time during which high pressure hydraulic fluid is applied to the rod end of the hydraulic cylinders 41 will tend to be short and thus any undesirable effect will be small. At the same time, the availability of sufficient force to withdraw the wedge members 42 from locking engagement will be insured.

It will be understood that various modifications may be made in the embodiment of this invention shown in the drawing and specifically described above. For example, a hydraulic means could be substituted for the electrical/electromagnetic means shown in FIG. 5 by which the valve means 52 is slaved to the valve means 53. More than two of the disclosed wedge devices could, of course, be used as desired, although one may be sufficient to produce the desired locking effect. The specific location of the wedging means may be changed and any suitable means may be substituted for the drive means 29 to rotate the circle structure 18 about its axis. It is believed that those skilled in the art will make various modifications in the specific embodiment of this invention as described herein to suit it for use on a particular motor grader structure.

What is claimed is:

1. In a motor grader comprising a main frame having a drawbar structure attached thereto and a working blade mounted on a circle member which is rotatably supported under said drawbar structure with an upper surface of said circle member vertically spaced from a lower surface of said drawbar structure by means of a plurality of spaced shoes rigidly fixed to said drawbar structure and slidably engaging the lower surface of said circle member; a control system comprising:

a. means for selectively rotating said circle member and said blade mounted thereon with respect to said drawbar structure about the axis of said circle member, and b. wedge means for selectively exerting a holding force simultaneously upon said lower surface of said drawbar structure and said upper surface of said circle member by selective wedging action thereupon caused by movement of said wedge means therebetween to force said lower surface of said circle member against said shoes and hold said circle member and said blade mounted thereon substantially immovable with respect to said drawbar structure in any position to which said circle member is selectively rotated about its axis with respect to said drawbar structure.

2. A control system in a motor grader as claimed in claim 1 wherein said wedge means includes a slide member, means for forcing said slide member between said upper surface of said circle member and said lower surface of said drawbar structure, and means for retracting said slide member from between said surfaces.

3. A control system in a motor grader as claimed in claim 2 wherein said wedge means includes a double-acting hydraulic cylinder adapted to be actuated both to force said slide member between said upper surface of said circle member and said lower surface of said drawbar and to retract said slide member from between said surfaces.

4. A control system in a motor grader as claimed in claim 3 wherein said upper surface of said circle member and said lower surface of said drawbar structure extend at a given angle with respect to each other and said slide member is provided with a pair of surfaces extending at said given angle with respect to each other adapted to mate with said upper surface of said circle member and said lower surface of said drawbar structure when forced therebetween.

5. A control system in a motor grader as claimed in claim 4 wherein said given angle is about ten degrees.

6. A control system in a motor grader as claimed in claim 2 including means for actuating said means for forcing said slide member between said surfaces whenever said means for rotating said circle member is not actuated and means for actuating said means for retracting said slide member from between said surfaces whenever said means for rotating said circle member is actuated.

7. A control system in a motor grader as claimed in claim 1 wherein said wedge means includes a plurality of slide members spaced from each other about the periphery of said circle member, means for forcing said slide members between said upper surface of said circle member and said lower surface of said drawbar structure substantially simultaneously with each other, and means for retracting said slide members from between said surfaces substantially simultaneously with each other.

8. A control system in a motor grader as claimed in claim 7 wherein said wedge means comprises a pair of slide members adapted to move in opposition to each other along a common line parallel to a line drawn diametrically through the center of said circle member.

9. A control system in a motor grader as claimed in claim 7 wherein said wedge means includes a double-acting hydraulic cylinder mechanically connected to at least one of said plurality of slide members, said hydraulic cylinder providing both said means for forcing said slide member between said upper surface of said circle member and said lower surface of said drawbar structure and said means for retracting said slide member from between said surfaces.

10. A control system in a motor grader as claimed in claim 9 wherein said means for selectively rotating said circle member comprises a hydraulic motor and said system includes manually operable control means having a neutral position and two alternate actuating positions; said control means being adapted to actuate said double-acting hydraulic cylinder to force said slide member between said surfaces when in its neutral position and to actuate said double-acting hydraulic cylinder to retract said slide member from between said surfaces when in either of said two alternate actuating positions thereof; and said control means being adapted to actuate said hydraulic motor to rotate in one direction when said control means is in one of said two alternative actuating positions and to rotate in the other direction when said control means is in the other of said two alternate actuating positions, said hydraulic motor not being actuated to rotate in either direction when said control means is in said neutral position.

* * * * *

UNITED STATES PATENT AND TRADEMARK OFFICE

CERTIFICATE OF CORRECTION

PATENT NO. : 3,999,615

DATED : December 28, 1976

INVENTOR(S) : FRANCIS H. HART and CARL A. HIGAR

It is certified that error appears in the above-identified patent and that said Letters Patent are hereby corrected as shown below:

Column 8, line 54, after "drawbar" insert --structure--;

Column 10,line 20, change "alternative" to --alternate--.

Signed and Sealed this

Second Day of May 1978

[SEAL]

*Attest:*

RUTH C. MASON
*Attesting Officer*

LUTRELLE F. PARKER
*Acting Commissioner of Patents and Trademarks*